United States Patent [19]

Endoh et al.

[11] Patent Number: 5,046,947

[45] Date of Patent: Sep. 10, 1991

[54] IMAGE FIXING APPARATUS

[75] Inventors: Michiaki Endoh; Hironobu Saito, both of Yokohama, Japan

[73] Assignee: Canon Kabushiki Kaisha, Tokyo, Japan

[21] Appl. No.: 343,388

[22] Filed: Apr. 26, 1989

[30] Foreign Application Priority Data

Apr. 28, 1988 [JP] Japan ..... 63-106765

[51] Int. Cl.[5] ..... F27B 9/28

[52] U.S. Cl. ..... 432/60; 219/469

[58] Field of Search ..... 432/60, 59, 63, 228, 432/227; 219/469

[56] References Cited

U.S. PATENT DOCUMENTS 4,043,747 8/1977 Ogiwara ..... 432/60

FOREIGN PATENT DOCUMENTS 53-39237 9/1978 Japan .

*Primary Examiner*—Henry Bennett

*Attorney, Agent, or Firm*—Fitzpatrick, Cella, Harper & Scinto

[57] ABSTRACT

A fixing apparatus includes rotatable member contactable to a material carrying a toner image to fix the toner image thereon, a first contacting member in sliding contact with a surface of the rotatable member, the first contacting member is reciprocable in a direction of a generating line of the rotatable member, a second contacting member in sliding contact with the surface of the rotatable member at a position different from the first contacting member in a rotational direction, the second contacting member being reciprocable in a direction of generating line of the rotatable member, wherein the first contacting member having a reciprocable movable range without overlapping with a reciprocable movable range of the second contacting member.

8 Claims, 2 Drawing Sheets

IMAGE FIXING APPARATUS

FIELD OF THE INVENTION AND RELATED ART

The present invention relates to an image fixing apparatus for an image forming apparatus wherein means contacting an outer surface of a rotatable fixing roller is reciprocated in a longitudinal direction of the roller.

In a widely used image fixing apparatus wherein a toner image is fixed on an image supporting member, the toner image is pressed, or pressed and heated by rotatable members such as a roller and a belt. Usually, the fixing apparatus comprises a separating pawl and a temperature detecting element such as a thermister connected to the rotatable member. The portion of the roller contacting those elements is more easily worn than the other portion, and the wearing and other damage caused thereby necessitates frequent replacement of the roller.

In order to solve this problem, Japanese Utility Model Application Publication 39237/1978 proposes that a separating pawl alone is reciprocated to prevent the sliding contact at a fixed position.

U.S. Pat. No. 4,043,747 proposes that the temperature detecting element alone is reciprocated. These publications propose that only one of the elements is reciprocated, and do not disclose reciprocating plural means contacting the roller.

When plural contacting members are moved, it would be possible that the local wearing is hardly prevented, depending on the way in which the contacting members are moved.

If a contact element such as a separating pawl and temperature detecting elements are simultaneously moved parallel to the axis of the roller independently from each other without a clear boundary between their respective movable ranges, the moving ranges of the contacting members can be overlap. If this occurs, the wearing of the fixing roller at the overlapped portion is increased with the result of a decrease in durability. If the moving range of a member is smaller than the width of the contacting member, there exists a portion where the contacting member always contacts the fixing roller within the moving range, with the result that the wearing of the fixing roller at this portion is increased with the same result.

SUMMARY OF THE INVENTION

Accordingly, it is a principal object of the present invention to provide an image fixing apparatus wherein plural members contacting a fixing member are moved.

It is another object of the present invention to provide an image fixing apparatus wherein the movable ranges of the plural contacting members are not overlapped.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
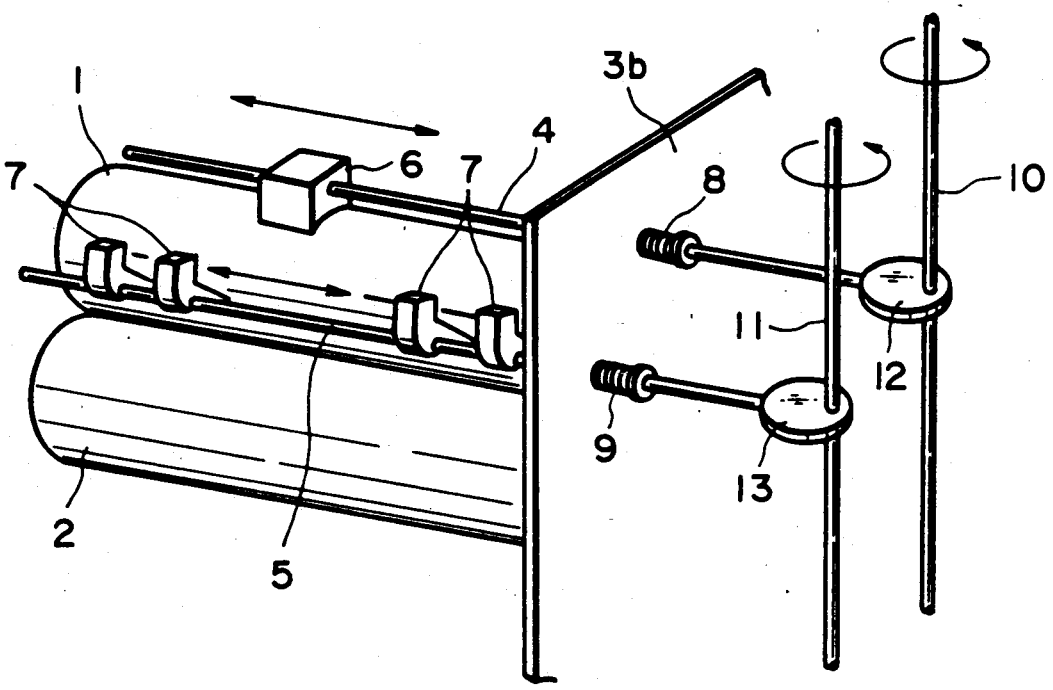
FIG. 1 is a perspective view of an image fixing apparatus according to an embodiment of the present invention.

The preferred embodiments of the present invention will be described in conjunction with the accompanying drawings wherein the elements having corresponding functions are assigned the same reference numerals.

Figure 2:
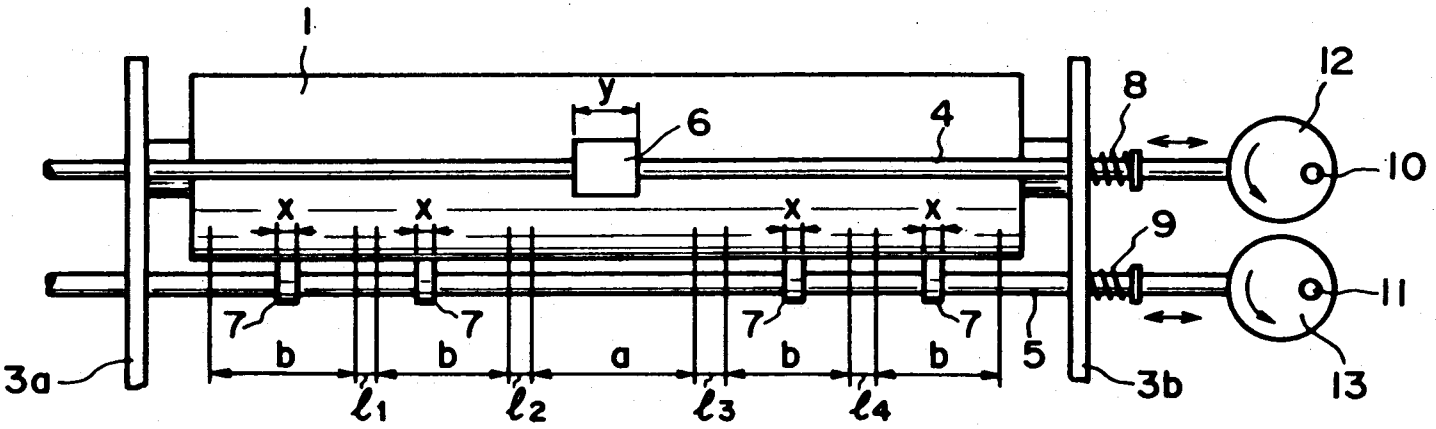
FIG. 2 is a top plan view of the image fixing apparatus of FIG. 1.

Referring to FIGS. 1 and 2, there is shown an image fixing apparatus according to an embodiment of the present invention. The fixing apparatus comprises a fixing roller 1 and a pressing or back-up roller which are rotatably mounted between supporting plate 3*a* and 3*b*. Those rollers are press-contacted with a predetermined pressure, and they are rotationally driven about their axes by an unshown driving means.

Two rods 4 and 5 are extended between the supporting plate 3*a* and 3*b* parallel with the fixing roller 1 for horizontal movement. Rod 4 has a temperature detector 6 such as a thermister mounted thereto at a position corresponding to the longitudinal center of the fixing roller 1. The temperature detecting element 6 is resiliently pressed to the surface of the fixing roller 1 to detect the temperature of the fixing roller 1.

The fixing roller 1 contains therein an unshown heater such as a halogen heater or the like, which is on-off controlled in accordance with output of the temperature detecting element. By this arrangement, the surface of the roller 1 is maintained at a predetermined temperature.

The other rod 5 has two separating pawls 7, 7 mounted thereto at each side of the temperature detector 6, that is, four separating pawls 7 in total are mounted on the rod 5. The separating pawls 7 have edge portions which are in sliding contact with the surface of the fixing roller 1 to prevent the transfer material from wrapping around the fixing roller 1 due to the adhesive force of the developer deposited on the surface thereof. The separating pawls are resiliently press-contacted to the fixing roller 1, similar to the temperature detector 6.

One longitudinal end of each of the rods 4 and 5 is projected outwardly through one of the supporting plates 3*b*. As will be understood from FIGS. 1 and 2, the rods 4 and 5 are normally urged rightwardly by the springs 8 and 9 mounted to the projected portions of the rods.

Outside the supporting plate 3*b*, there are two driving shafts 10 and 11 extending vertically and parallel with each other. Those shafts are rotationally driven by an unshown driving means in the direction of arrows in FIG. 1. At a middle portion of each of the driving shafts 10 and 11, an eccentric cam 12 or 13 in the form of an eccentric disc is mounted. The outer cam periphery of the eccentric cams 12 and 13 and the respective ends of the rods 4 and 5 are resiliently contact each other.

When the driving shafts 10 and 11 are rotated in the directions indicated by an arrows in FIG. 1, the eccentric cams 12 and 13 are also rotated integrally therewith. By the rotation of the eccentric cams 12 and 13, the rods 4 and 5 are urged to the outer peripheries thereof, and therefore, the temperature detector 6 and the separating pawls 7 mounted to the rods 4 and 5, respectively are reciprocated in the direction of the axis of the fixing roller, as shown by arrows in FIG. 1. Thus, the plural members having different functions and contacting the roller are reciprocated in the direction of the generating line of roller.

The distance of the reciprocal movement of each of the temperature detector 6 and the separating pawls 7 is determined by the amount of eccentricity of the associated eccentric cam 12 or 13. Referring to FIG. 2, the eccentric cams 12 and 13 have such amounts of eccentricity that the distance $a-y$ of reciprocal movement of the temperature detecting element 6 is larger than a width y of the temperature detecting element 6 itself ($a-y>y$) (a is the range contacted by the temperature detector 6 by the reciprocal movement), and that the distance of reciprocal movement of each of the separating pawls ($b-x$) is larger than a width x of the separating pawl 7 itself ($b-x>x$) (b is a range contacted by the separating pawl 7 by the reciprocal movement). In addition, the position where the temperature detector 6 is mounted on the rod 4 and the positions where the separating pawls 7 are mounted on the rod 5 are determined such that the ranges a and b in which the temperature detector 6 and the separating pawls 7 contact to the roller do not overlapped. More particularly, the intervals $l_1$, $l_2$, $l_3$ and $l_4$ between the reciprocating ranges satisfy:

$$l_1>0, l_2>0, l_3>0 \text{ and } l_4>0.$$

With this structure, the temperature detecting element 6 and the separating pawls 7, or the separating pawls 7, simultaneously contact to the fixing roller 1 at the same position. Therefore, the local wearing of the fixing roller due contacting both of the temperature detecting element 6 and the separating pawl 10. 7, can be prevented.

In addition, it can be avoided that the temperature detector 6 (or the separating pawls 7) itself always contacts to the same portion of the surface of the fixing roller in the movable range of the temperature detecting element 6 (or the separating pawls 7). The local wearing of the fixing roller 1 surface is further prevented, and therefore, the amount of wearing is uniform along the length of the fixing roller, thus increasing the durability of the fixing roller.

Figure 3:
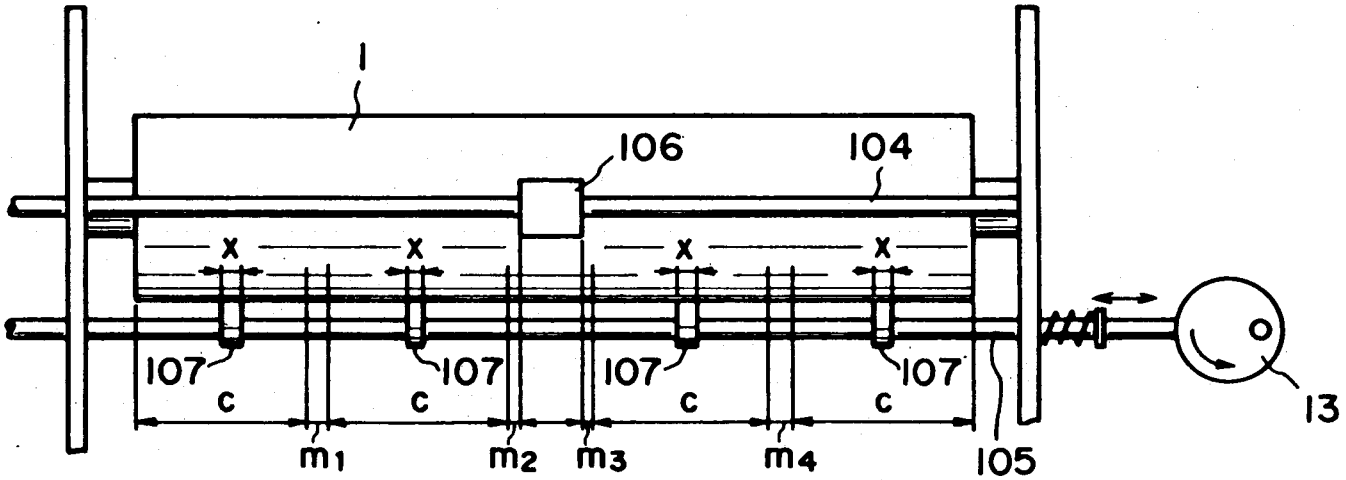
FIG. 3 is a top plan view of an image fixing apparatus according to another embodiment of the present invention.

Referring to FIG. 3, another embodiment of the present invention will be described. In this embodiment, a rod 104 is fixed and is not movable. Therefore, the temperature detector 106 mounted to the rod 104 is not movable. Only the separating pawls 107 are reciprocally moved along the axis of the fixing roller 1 by rotation of the eccentric cam 13 similar to the first embodiment. The amount of eccentricity of the eccentric cam 13 is so-determined that the distance of reciprocal movement ($c-x$) is larger than a width x of the separating pawl 107 ($c-x>x$) (c is a range covered by the reciprocating separating pawl 107, that is, the distance in which the reciprocating separating pawl 107 is contacted), similar to the first embodiment. Also, similar to the first embodiment, the mounting position of the separating pawls 107 on the rod 105 are determined so that the contact ranges in the reciprocating movement of the separating pawls 107 do not overlap, that is, the intervals $m_1$, $m_2$, $m_3$ and $m_4$ between the reciprocable moving ranges satisfy:

$$m_1>0, m_2>0, m_3>0 \text{ and } m_4>0.$$

The same advantageous effects as in the first embodiment can be provided also in this embodiment.

However, since wear is larger at the portion where the temperature detecting element is contacted, it is preferable that the temperature detecting element is also moved.

In the foregoing embodiments, the fixing apparatus has been described as being provided with the temperature detecting element and the separating pawls as the members contact to the fixing roller, but the present invention is applicable to a fixing apparatus having additional contacting members.

While the invention has been described with reference to the structures disclosed herein, it is not confined to the details set forth and this application is intended to cover such modifications or changes as may come within the purposes of the improvements or the scope of the following claims.

What is claimed is:

1. A fixing apparatus, comprising:

a rotatable member contactable to a material carrying a toner image to fix the toner image thereon said rotatable member being heated by a heating source;

temperature detecting means, contactable to a surface of said rotatable member to detect the temperature of the surface of said rotatable member, said temperature detecting means being reciprocable in a direction of a generating line of said rotatable member;

a separating member, contactable to the surface of said rotatable member, to separate the toner carrying material from said rotatable member, said separating member being reciprocable in the direction of the generating line of said rotatable member;

wherein the difference between the reciprocating range of said temperature detecting means and the width of contact of said temperature detecting means with said rotatable member is larger than the width of contact of said temperature detecting means with said rotatable member, wherein the difference between the reciprocating range of said separating member and the width of contact of said separating member with said rotatable member is larger than the width of contact of said separating member with said rotatable member, and wherein the reciprocation ranges of said temperature detecting means and said separating member do not overlap in the direction of the generating line.

2. An apparatus according to claim 1, further comprising a plurality of said separating members, and wherein said plurality of separating members are supported on a supporting member, wherein said separating members are a supporting member, wherein said separating members are reciprocated by moving the supporting member.

3. An apparatus according to claim 1, further comprising an eccentric cam for reciprocating said temperature detecting means and said separating member.

4. A fixing apparatus, comprising:

a rotatable member heated by a heating source supplied with electrical power to fuse toner;

temperature detecting means for detecting the temperature of a surface of a said rotatable member, said temperature detecting means being supported in a fixed position, wherein said temperature detecting means produces an output for controlling the electrical power;

a plurality of separating members contacting the surface of said rotatable member to separate a material supporting a toner image from said rotatable member, said plurality of separating members being movable in a direction of a generating line of said rotatable member; and wherein said temperature detecting means is stationarily disposed between said plurality of separating members in a direction of the generating line without overlapping the range within which said plurality of separating members move.

5. An apparatus according to claim 4 further comprising a supporting member for supporting said plural separating members, and wherein said separating members are moved by moving said supporting member.

6. An apparatus to claim 4, wherein the distance over which said plurality of separating members are moved is larger than the contact widths of the respective separating members.

7. An apparatus according to claim 4, further comprising an eccentrical cam for moving said separating members.

8. An apparatus according to claim 1 or 4, wherein said rotatable member is contactable to the toner image before being fixed.

* * * * *

UNITED STATES PATENT AND TRADEMARK OFFICE

CERTIFICATE OF CORRECTION

PATENT NO. : 5,046,947

DATED : September 10, 1991

INVENTOR(S) : Michiaki Endoh et al.

It is certified that error appears in the above-identified patent and that said Letters Patent is hereby corrected as shown below:

COLUMN 1:

Line 40, "be" should be deleted.

COLUMN 2:

Line 11, "the" should be deleted; and

Line 60, "are" should be deleted.

COLUMN 3:

Line 4, "of" should read --of the--;

Line 24, "to" should be deleted; and "overlapped" should read --overlap--;

Line 32, "to" should be deleted;

Line 35, "10." should be deleted; and

Line 39, "to" should be deleted.

COLUMN 4:

Line 10, "contact to" should read --contacting--.

UNITED STATES PATENT AND TRADEMARK OFFICE

CERTIFICATE OF CORRECTION

PATENT NO. : 5,046,947

DATED : September 10, 1991

INVENTOR(S) : Michiaki Endoh et al.

It is certified that error appears in the above-identified patent and that said Letters Patent is hereby corrected as shown below:

COLUMN 4:

Line 54, "are a supporting member, wherein said" should be deleted.

Line 55, "separating members" should be deleted.

COLUMN 5:

Line 12, after "4" insert --,-- (a comma).

Signed and Sealed this

Thirteenth Day of April, 1993

*Attest:*

*Attesting Officer*

STEPHEN G. KUNIN

*Acting Commissioner of Patents and Trademarks*